US007503192B1

(12) United States Patent
Pai

(10) Patent No.: US 7,503,192 B1
(45) Date of Patent: Mar. 17, 2009

(54) CORDUROY FABRIC

(75) Inventor: Tieh-Hsiung Pai, Taipei Hsien (TW)

(73) Assignee: Pai Lung Machinery Mill Co., Ltd, Jui-Fang Town, Taipei Hsien (TW)

( * ) Notice: Subject to any disclaimer, the term of this patent is extended or adjusted under 35 U.S.C. 154(b) by 0 days.

(21) Appl. No.: 11/898,466

(22) Filed: Sep. 12, 2007

(51) Int. Cl.
*D04B 7/12* (2006.01)

(52) U.S. Cl. ..... 66/194

(58) Field of Classification Search ..... 66/170, 66/171, 169 R, 190, 191, 194, 202
See application file for complete search history.

(56) References Cited

U.S. PATENT DOCUMENTS 3,365,918 A * 1/1968 Hughes ..... 66/192
3,769,816 A * 11/1973 Ploch et al. ..... 66/193
3,835,512 A * 9/1974 Piller et al. ..... 28/156
5,271,983 A * 12/1993 Ise et al. ..... 428/92
5,422,153 A * 6/1995 Miyamoto ..... 428/95
5,428,969 A * 7/1995 Day et al. ..... 66/202
5,855,125 A * 1/1999 Lohmueller et al. ..... 66/196
6,094,944 A * 8/2000 Schmidt ..... 66/92
6,096,667 A * 8/2000 Rhode ..... 442/313
6,745,600 B2 * 6/2004 Weiqing et al. ..... 66/194

* cited by examiner

*Primary Examiner*—Danny Worrell
(74) *Attorney, Agent, or Firm*—Muncy, Geissler, Olds & Lowe PLLC

(57) ABSTRACT

The corduroy fabric includes a plurality of transverse weft yarn sets. Each consists of at least three yarns and includes a plurality of pile yarn warp loops consisting of yarns having yarn forming at least one pile end, and a plurality of binding yarn warp loops consisting of at least two yarns. Each of the binding yarn warp loops is located respectively at two sides of a selected number of the pile yarn warp loops and has one common yarn winding a selected number of the pile yarn warp loops to form a binding yarn cross with the pile end. The pile yarn warp loops and the binding yarn warp loops of one transverse weft yarn set are crossly woven consecutively with longitudinal neighboring pile yarn warp stitches and the binding yarn warp loops of a next transverse weft yarn set to form a plurality of longitudinal warp loop pile zones.

6 Claims, 10 Drawing Sheets

CORDUROY FABRIC

FIELD OF THE INVENTION

The present invention relates to a fabric formed by crocheting yarns through knitting needles and particularly to a corduroy fabric fabricated by a circular knitting machine.

BACKGROUND OF THE INVENTION

Corduroy fabrics generally have a greater thickness and a desirable warm-keeping characteristic, thus are suitable for making autumn and winter overcoats, and ornamental articles such as outer layers of shoes and hats, draperies, curtains, surface fabrics of sofas, and the like. There are many types of corduroy fabrics. Depending on the size of pile strips, they can be divided into extra fine strip, fine strip, medium strip, coarse strip, and broad strip. Other types also are available, such as with coarse strips and fine strips spaced alternatively, without cutting piles on a portion of the strips, or having the piles cut in a bias manner to form alternative heights on the strips, or the like. In general, the corduroy fabric is formed by weaving medium yarns. The ground fabric can adopt plain weave, twill weave, altered weft plain weave or the like.

The conventional corduroy fabric is fabricated by shuttle weaving. The fabric consists of one set of warp yarns and two sets of weft yarns woven manually or through semi-automatic machines. Referring to FIGS. 1A and 1B for a conventional V-shaped corduroy fabric fabricated by shuttle weaving with the pile yarns cut in a V-shape. It has a ground fabric formed by weaving one set of weft yarns (or called ground wefts 11 and 12) and warp yarns 21 and 22 to fasten piles, and another set of weft yarns (or called pile wefts 911 and 912) and the warp yarns 21 and 22 woven to form regular float wefts 971 and 972. The float wefts 971 and 972 are cut to form V-shaped piles 921 and 922. Then the pile wefts 911 and 912 are cut and the V-shaped piles 921 and 922 direct upwards in V-shape. Hence the fabric surface forms a plurality of longitudinal pile strips 2912 which have a cross section like lamp wicks to become a corduroy fabric.

The fabric shown in FIG. 1A adopts a 1:2 plain weaving ground. The ground fabric is formed by weaving consecutively two pile wefts 911 and 912 for every woven ground weft 11, and the warp yarns 21 and 22, and the ground wefts 11 and 12 are woven to form the ground fabric so that the pile wefts 911 and 912 have a regular length (generally at a length of 5-6 warp yarns) floating on the fabric surface. Referring to FIG. 1B, after the pile wefts 911 and 912 have been cut, the piles 921 and 922 are formed in a V-shape and fastened by the ground fabric (formed by the warp yarns 21, 22, and weft yarns 11 and 12). As the V-shaped piles 921 and 922 are fastened to the ground fabric at a few cross weaving spots formed by the warp yarns 21 and 22, the V-shaped piles 921 and 922 are easily loosened off. Hence such a weaving method is generally adoptable to a broad strip corduroy fabric with a high weft density. Ii usually is woven manually or through semi-automatic machines. As a result, production efficiency is lower.

Refer to FIG. 2 for another type of conventional corduroy fabric with a W-shaped pile structure. It also adopts a 1:2 plain weaving ground. It has a ground fabric formed by weaving one weft yarn 13 and two consecutive pile wefts 23 and 24 (no mark in the drawing), and weaving warp yarns 23, 24, 25 and 26 and ground wefts 13 and 14 so that the pile weft has a regular length (generally at a length of 4-5 warp yarns) floating on the fabric surface. After cut, the pile wefts form W-shaped piles 981 and 982 clipped by the ground fabric (formed by the warp yarns 23, 24, 25 and 26, and the ground wefts 13 and 14). The W-shaped piles 981 and 982 and the warp yarns are woven with a greater number of crossed spots, thus can form a more secured fastening than the V-shaped piles. It generally is suitable for fabricating medium strip or fine strip corduroy fabrics. But fabricated by the conventional shuttle weaving, the resulting W-shaped piles 981 and 982 still could loosen off, and production efficiency still is not desirable.

In short, the conventional corduroy fabrics fabricated by shuttle weaving, either with V-shaped or W-shaped piles, still have common problems remained to be overcome, notably:

1. the piles easily loosen off; and
2. production efficiency is too low.

SUMMARY OF THE INVENTION

Therefore the primary object of the present invention is to solve the aforesaid problems by providing a corduroy fabric that has piles fastened more securely and can be fabricated at a higher production efficiency.

To achieve the foregoing object the corduroy fabric according to the invention is fabricated through a circular knitting machine. Its structure includes a plurality of transverse weft yarn sets consisting of at least three yarns. Each of the transverse weft yarn sets includes a plurality of pile yarn warp loops consisting of at least two yarns in which at least one yarn in the pile yarn warp loops has at least one pile end, and a plurality of binding yarn warp loops consisting of at least two yarns. Each binding yarn warp loop is located at two sides of a selected number of the pile yarn warp loops. At least one common yarn winds around the selected number of pile yarn warp loops to form a binding yarn woven with the pile end in a staggered fashion. The pile yarn warp loop and the binding yarn warp loop of the transverse weft yarn set further are woven consecutively with the pile yarn warp loop and the binding yarn warp loop of a longitudinal neighboring transverse weft yarn set to form a plurality of longitudinal warp loop pile zones.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1A:
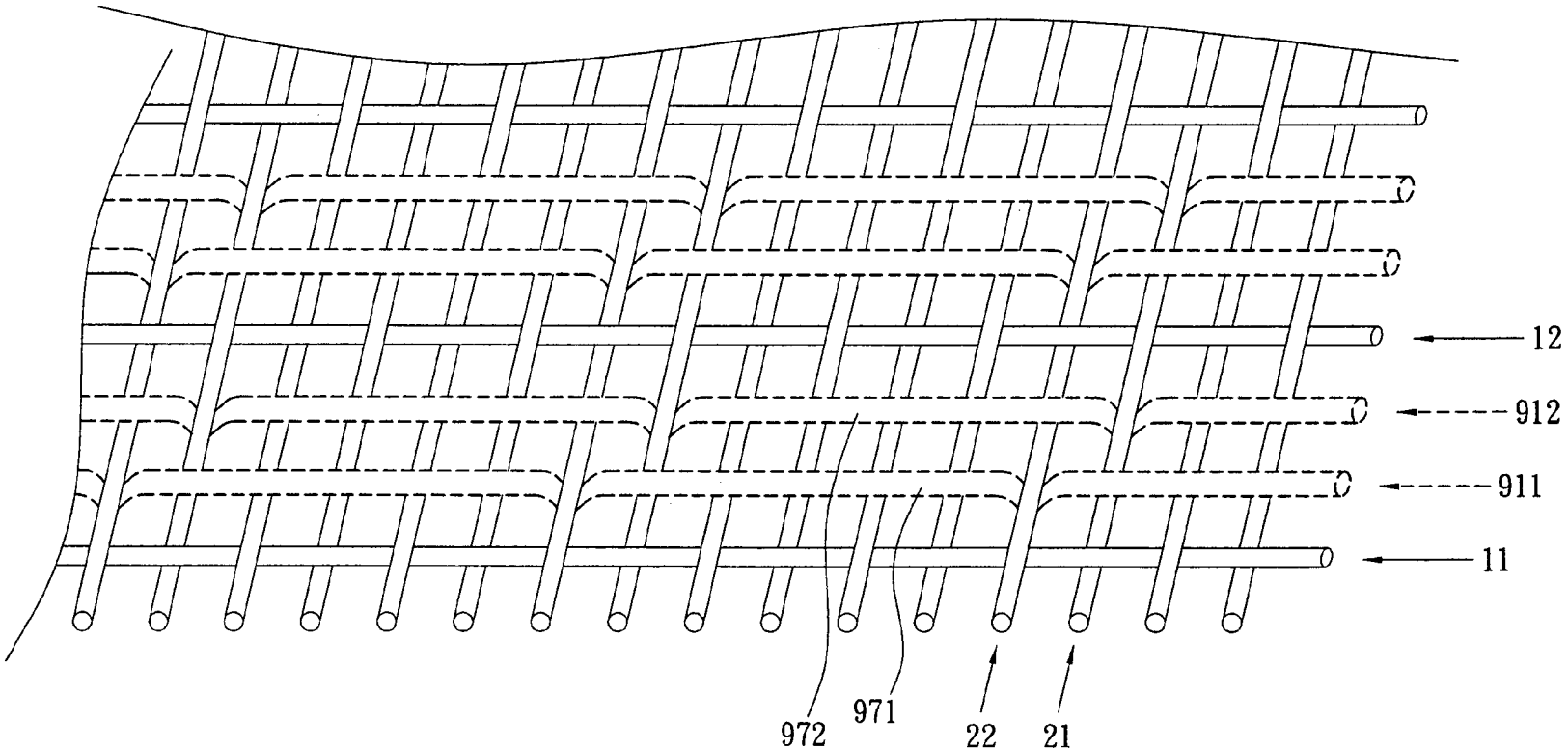
FIG. 1A PRIOR ART
FIG. 1A is a schematic view of a conventional V-shaped corduroy fabric structure fabricated by shuttle weaving.
Figure 1B:
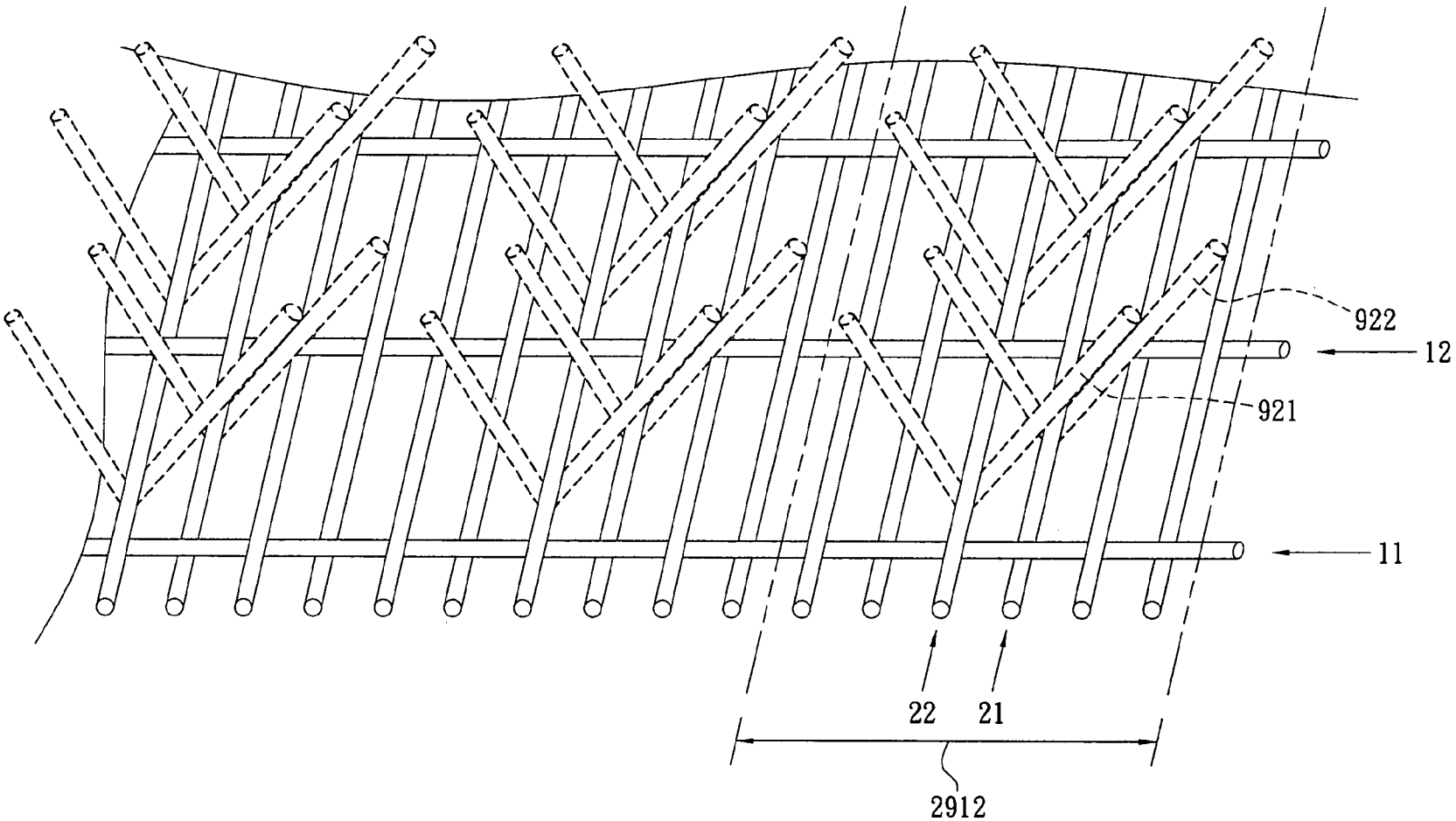
FIG. 1B PRIOR ART
FIG. 1B is schematic view according to FIG. 1A with the pile yarns cut in a V-shape.
Figure 2:
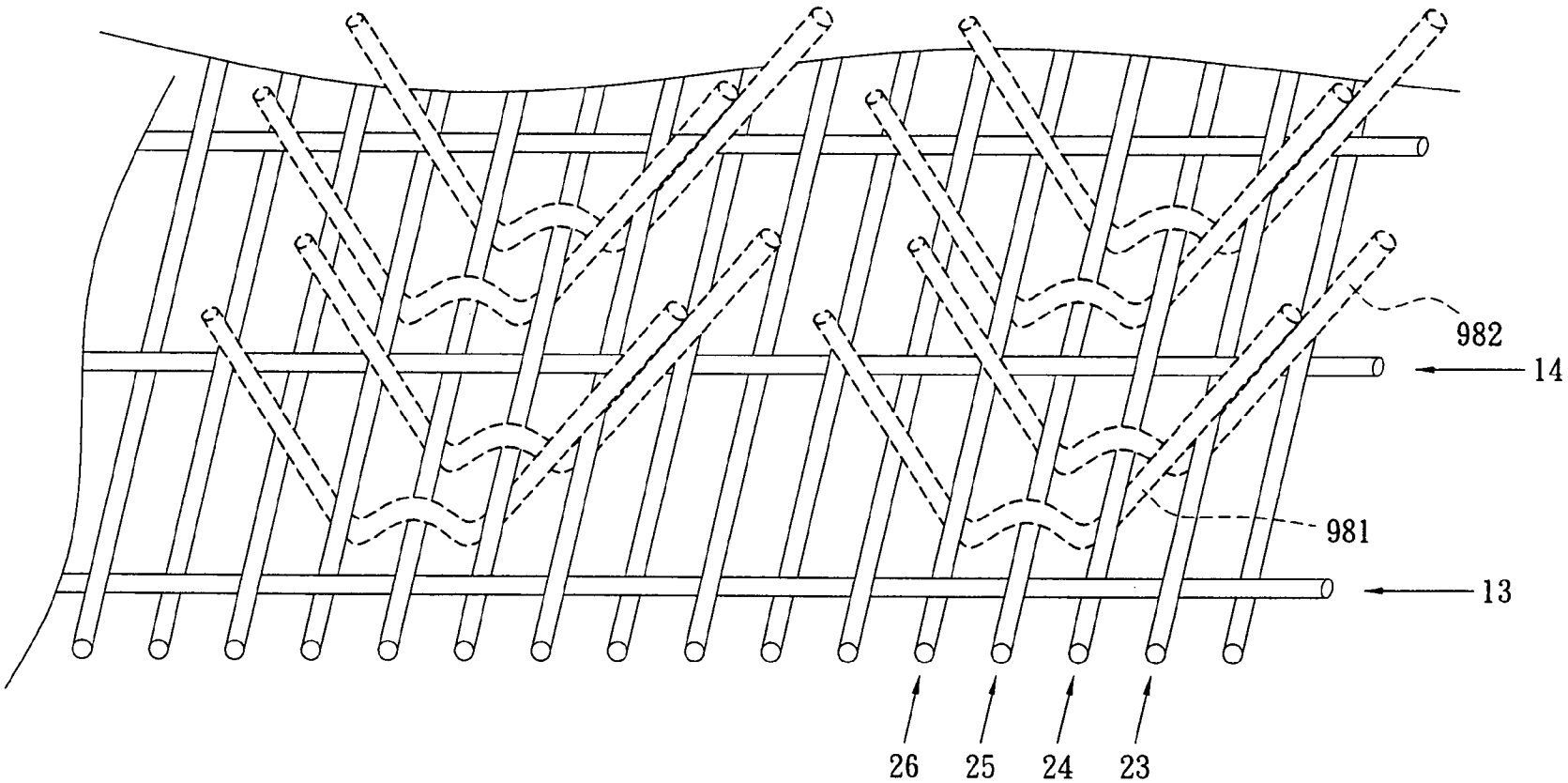
FIG. 2 PRIOR ART
FIG. 2 is a schematic view of another conventional corduroy fabric structure with the piles formed in a W-shape.

The corduroy fabric of the present invention is fabricated through a circular knitting machine. The operation principle and techniques of the circular knitting machine is known in the art, and form no part of the invention. Thus their details are not shown in the drawings and also not marked or discussed hereinafter.

Figure 3A:
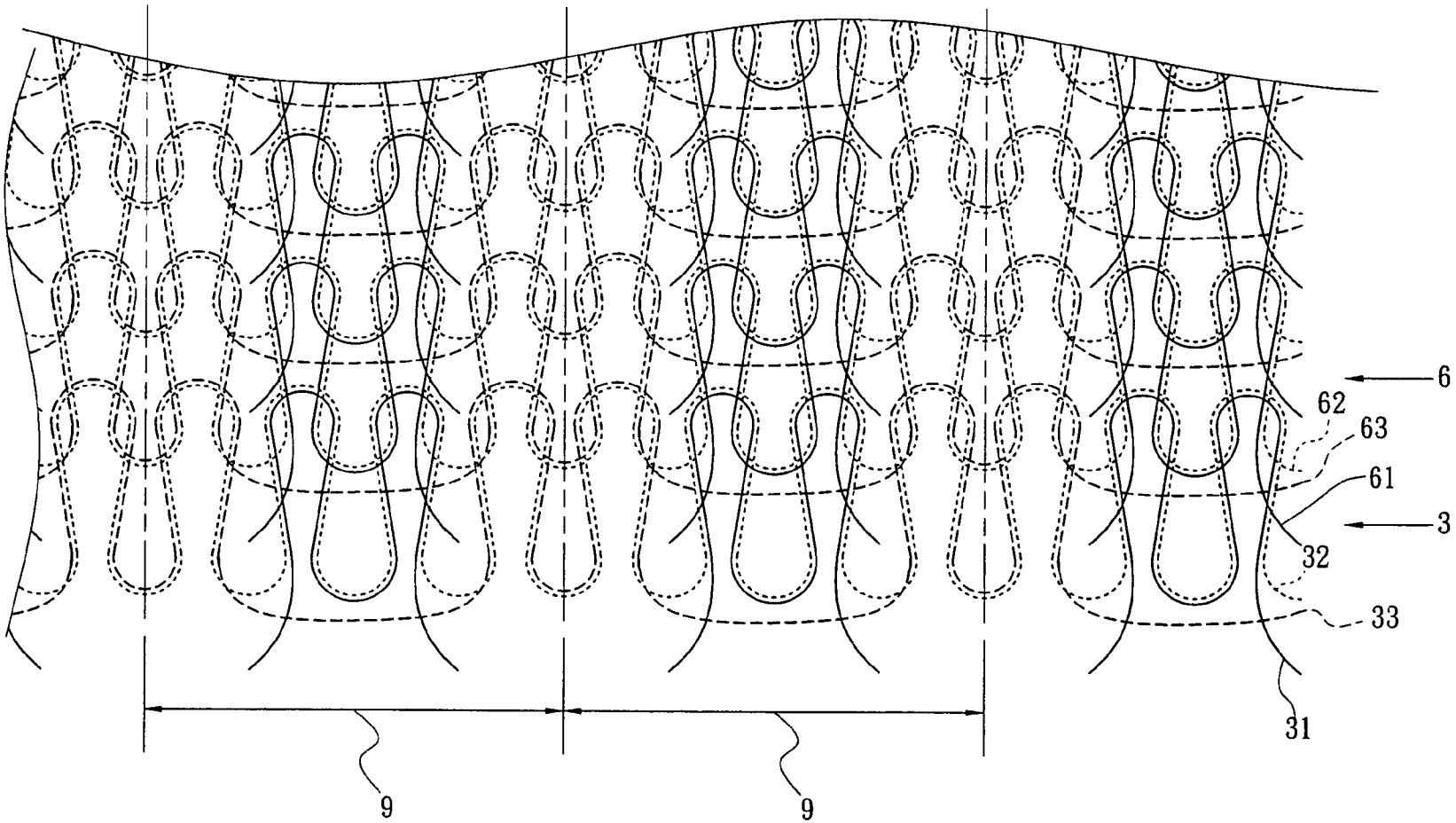
FIG. 3A is a fragmentary schematic view of a first type structure of the corduroy fabric of the invention.
Figure 3B:
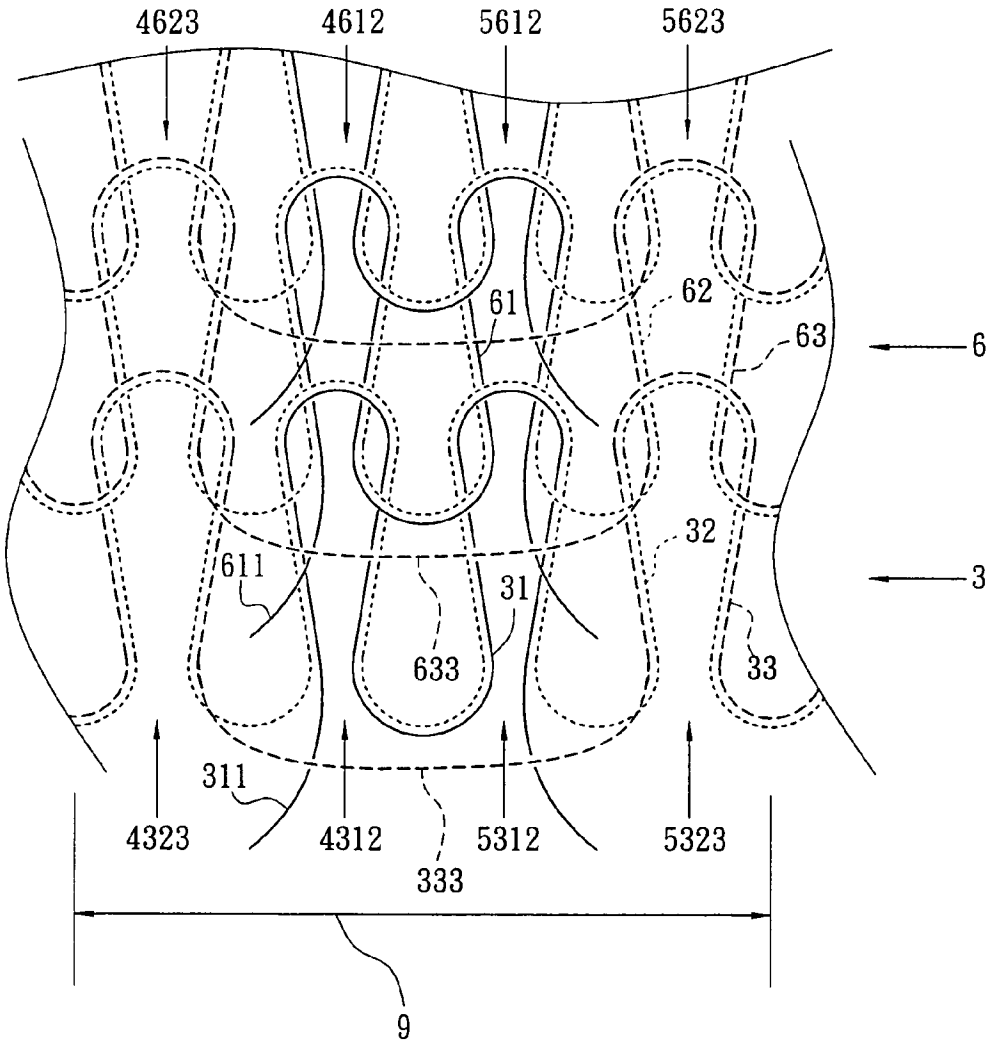
FIG. 3B is a fragmentary enlarged view according to FIG. 3A.

Refer to FIGS. 3A and 3B for the fragmentary schematic view of a first type structure of the corduroy fabric of the invention. In the drawings only a fabric consisting of two sets of transverse weft yarn sets 3 and 6 is marked with numerals for discussion.

As shown in the drawings, the transverse weft yarn set 3 includes three yarns 31, 32 and 33, and is crocheted separately by needles of a circular knitting machine to form a plurality of pile yarn warp loops 4312 and 5312, and a plurality of binding yarn warp loops 4323 and 5323. In one longitudinal warp loop pile zone 9 one pile yarn warp loop 4312 and another pile yarn warp loop 5312 have two yarns 31 and 32. The two yarns 31 and 32 of the pile yarn warp loop 4312 is obtained by two crochets of one needle, while the two yarns 31 and 32 of the pile yarn warp loop 5312 is obtained by two crochets of another needle. The yarn 31 has a pile end 311. The binding yarn warp loops 4323 and 5323 also have two yarns 32 and 33 located respectively on the left side of the pile yarn warp loop 4312 and the right side of another pile yarn warp loop 5312. The two yarns 32 and 33 of the binding yarn warp loop 4323 are obtained by two crotches of a needle different from the one of the pile yarn warp loops 4312 and 5312. And the two yarns 32 and 33 of another binding yarn warp loop 5323 are obtained by two crotches of one needle different the ones previously discussed. The binding yarn warp loops 4323 and 5323 have a common yarn 33, winding the pile yarn warp loops 4312 and 5312 to form a binding yarn 333 cross with its own pile end 311.

Another transverse weft yarn set 6 also includes three yarns 61, 62 and 63, and is crocheted separately by needles of the circular knitting machine to form a plurality of pile yarn warp loops 4612 and 5612, and binding yarn warp loops 4623 and 5623. As previously discussed, in the same longitudinal warp loop pile zone 9 mentioned above, one pile yarn warp loop 4612 and another pile yarn warp loop 5612 have two yarns 61 and 62. The two yarns 61 and 62 of the pile yarn warp loop 4612 is obtained by two crochets feeding under the transverse weft yarn set 6 through the same needle which forms the pile yarn warp stitch 4312 previously discussed, while the two yarns 61 and 62 of another pile yarn warp loop 5612 is obtained by two crochets feeding under the transverse weft yarn set 6 through the same needle which forms another pile yarn warp loop 5312 previously discussed. The yarn 61 also has a pile end 611. The binding yarn warp loops 4623 and 5623 also have two yarns 62 and 63 located respectively on the left side of the pile yarn warp loop 4612 and the right side of another pile yarn warp loop 5612. The two yarns 62 and 63 of the bind yarn warp stitch 4623 are obtained by two crotches feeding under the transverse weft yarn set 6 through the same needle which forms the binding yarn warp loop 4323 previously discussed. And the two yarns 62 and 63 of another binding yarn warp loop 5623 are obtained by two crotches feeding under the transverse weft yarn set 6 through the same needle which forms the binding yarn warp loop 5323 previously discussed. The binding yarn warp loops 4623 and 5623 have a common yarn 63, winding the pile yarn warp loops 4612 and 5612 to form a binding yarn 633 cross with its own pile end 611.

It is to be noted that the two yarns 61 and 62 of the pile yarn warp loop 4612 are obtained through the same needle forming the pile yarn warp loop 4312, that receives yarn feeding while being moved to a yarn outlet of the transverse weft yarn set 6 and crochets two times, then the needle releases the yarns 31 and 32 of the pile yarn warp loop 4312 from a yarn release ring. Hence the yarns 61 and 62 of the pile yarn warp loop 4612 pass through the yarns 31 and 32 of the pile yarn warp loop 4312 to form a consecutive cross weaving fashion. And the two yarns 61 and 62 of the pile yarn warp loop 5612 are obtained by the same needle forming the pile yarn warp loop 5312, that receives yarn feeding while being moved to a yarn outlet of the transverse weft yarn set 6 and crochets two times, then the needle releases the yarns 31 and 32 of the pile yarn warp loop 5312 from a yarn release ring. Hence the yarns 61 and 62 of the pile yarn warp loop 5612 pass through the yarns 31 and 32 of the pile yarn warp loop 5312 to form a consecutive cross weaving fashion. Thus, the needles are continuously moved to the next yarn outlet to feed the yarns and crochet the yarns separately. As a result, a consecutive cross weaving is proceeded to form a plurality of longitudinal warp pile zones 9 to become the corduroy fabric of the invention.

Compared with the conventional techniques the present invention provides the following advantages:

1. The pile end of the pile yarn warp loop of the corduroy fabric of the invention is bound by the binding yarn of the binding yarn warp loop, hence the problem of pile loosening occurred to the conventional corduroy fabric does not take place.

2. The corduroy fabric of the invention is fabricated through a circular knitting machine, thus production speed is faster and the production efficiency is higher than the conventional shuttle weaving.

Figure 4A:
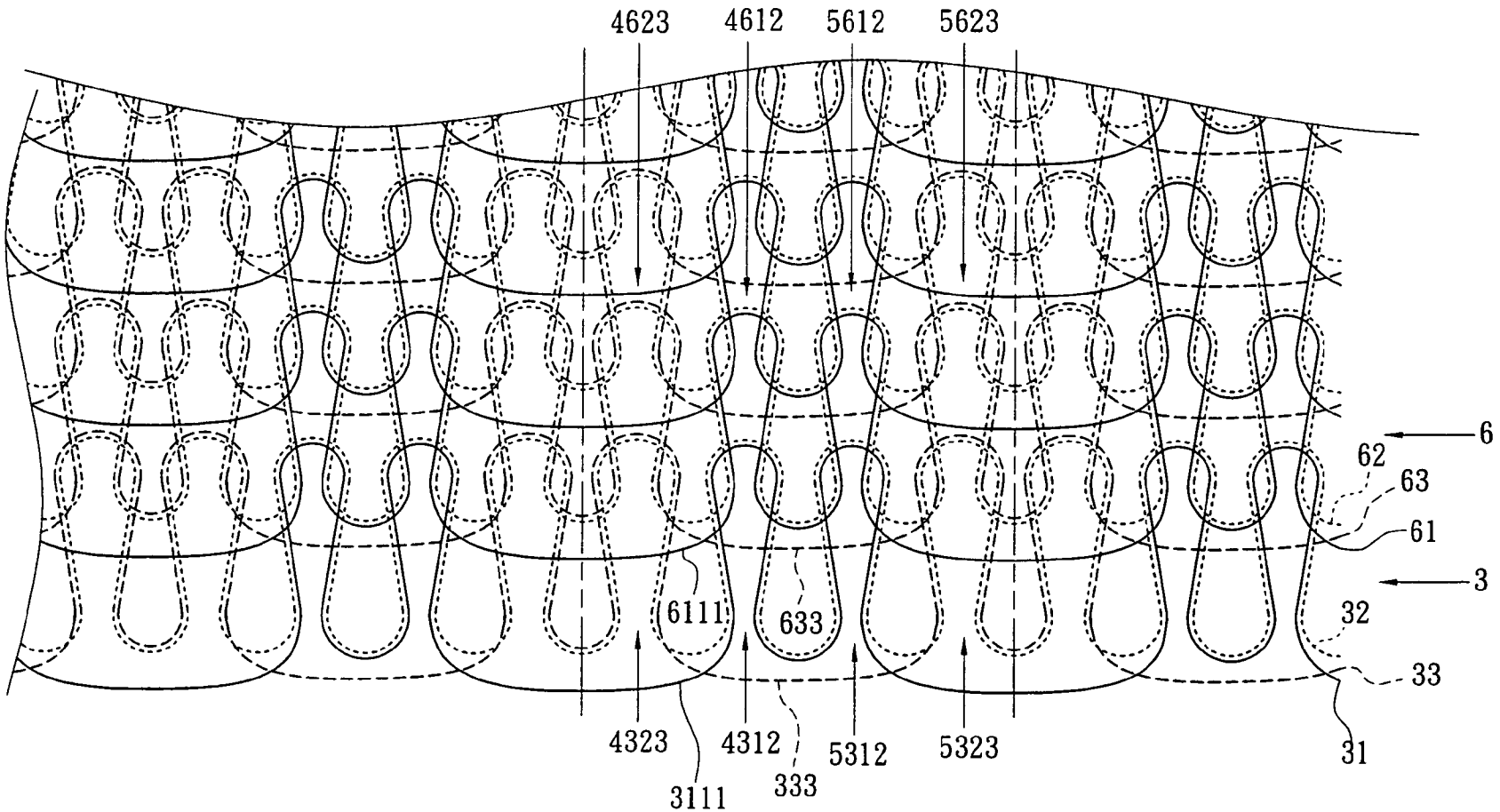
FIG. 4A is a fragmentary schematic view of the knitting fabric structure of a corduroy fabric of the invention.
Figure 4B:
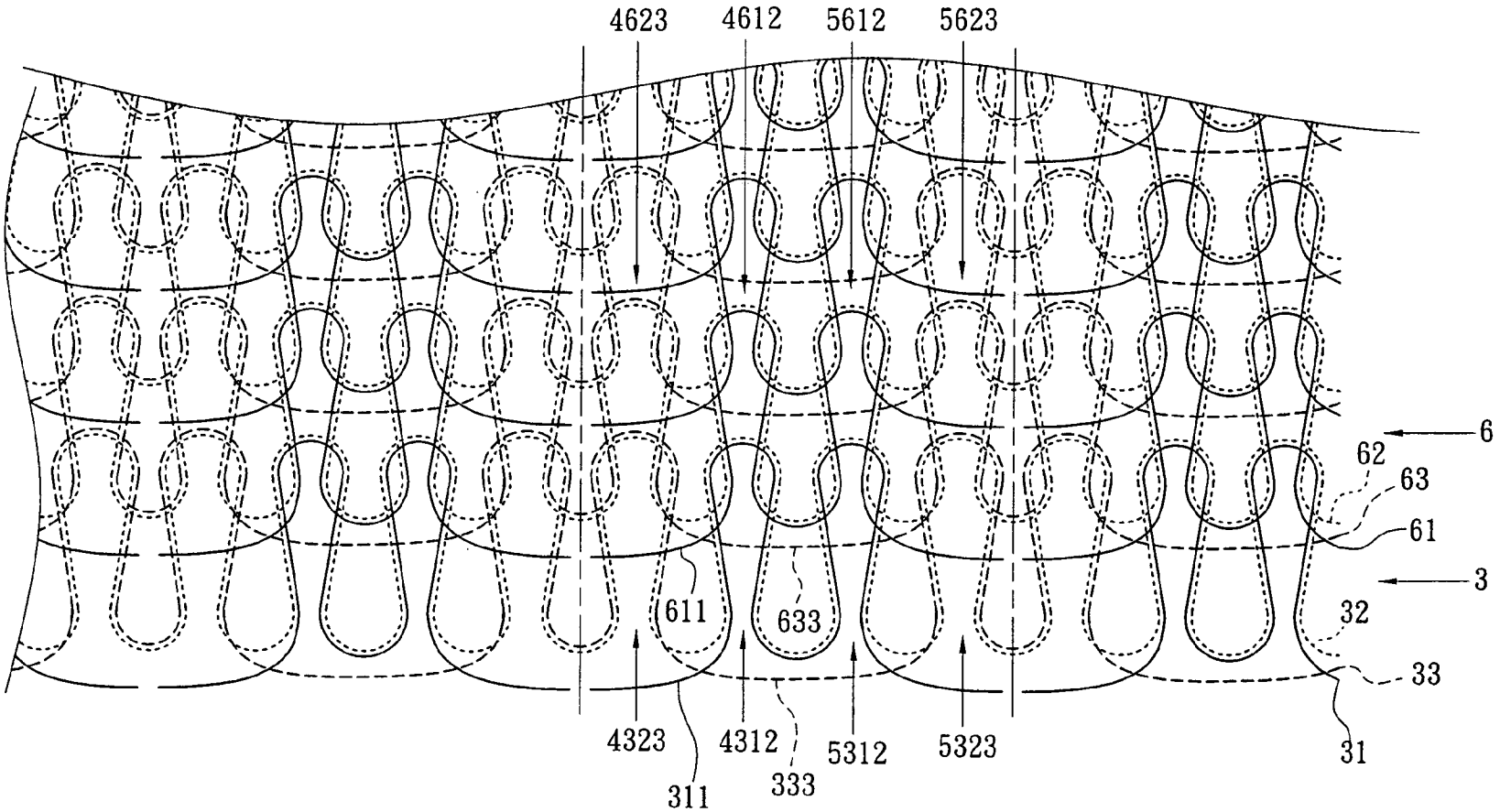
FIG. 4B is a fragmentary schematic view according to FIG. 4A showing a cutting pattern.

Refer to FIG. 4A for a fragmentary schematic view of the knitting fabric structure of a corduroy fabric of the invention. It is the anterior fabric structure of the corduroy fabric shown in FIGS. 3A and 3B after being knitted through the circular knitting machine. It is to be noted that the longitudinal warp loop pile zone 9 of each of the transverse weft yarn sets 3 and 6 has a float yarn 3111 and 6111. The binding yarn warp loops 4323, 5323, 4623 and 5623 have a common yarn 63 winding the pile yarn warp loops 4312 and 4612, and 5312 and 5612 to form the binding yarns 333 and 633. As the needle foot crocheted to form the pile yarn warp loops 4312, 5312, 4612 and 5612 and the needle foot crocheted to form the bind yarn warp stitches 4323, 5323, 4623 and 5623 travel on different tracks of a cam, hence the cam of the needles of the pile yarn warp loops 4312, 5312, 4612 and 5612 can be designed in a regular cycle on a plain track without crocheting the yarns 33 and 63 to form the binding yarns 333 and 633. And the cam of the needles of the pile yarn warp loops 4323, 5323, 4623 and 5623 can be designed in a regular cycle on a plain track without crocheting the yarns 31 and 61 to form the float yarns 3111 and 6111. The binding yarns 333 and 633, and the float yarns 3111 and 6111 can be designed to cross each other as shown in FIG. 4B. After the float yarns 3111 and 6111 are cut to form the pile ends 3111 and 611, they also are bound by the binding yarns 333 and 633, thus are fastened securely and less likely to loosen off.

Figure 5A:
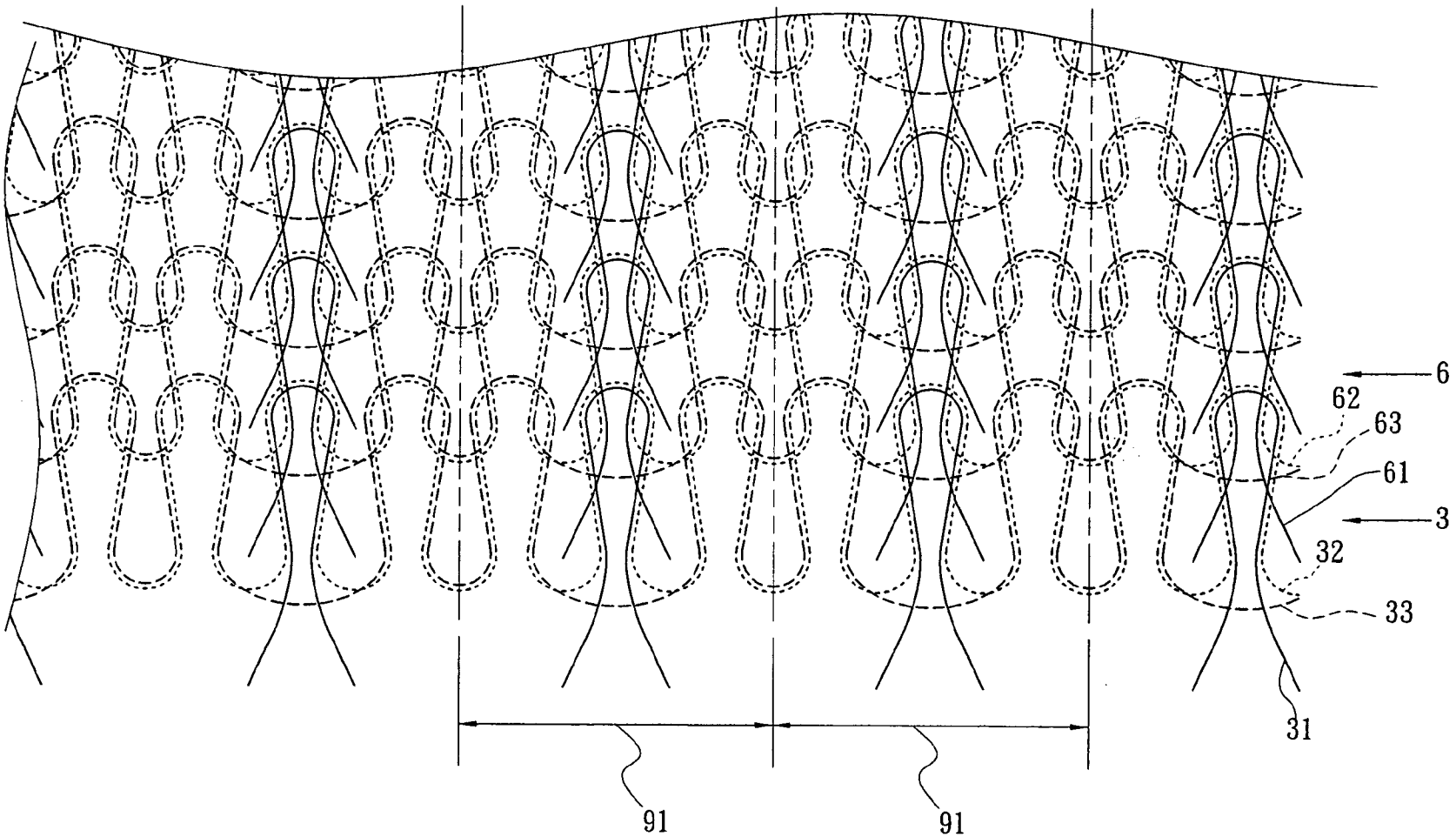
FIG. 5A is a fragmentary schematic view of a second type structure of the corduroy fabric of the invention.
Figure 5B:
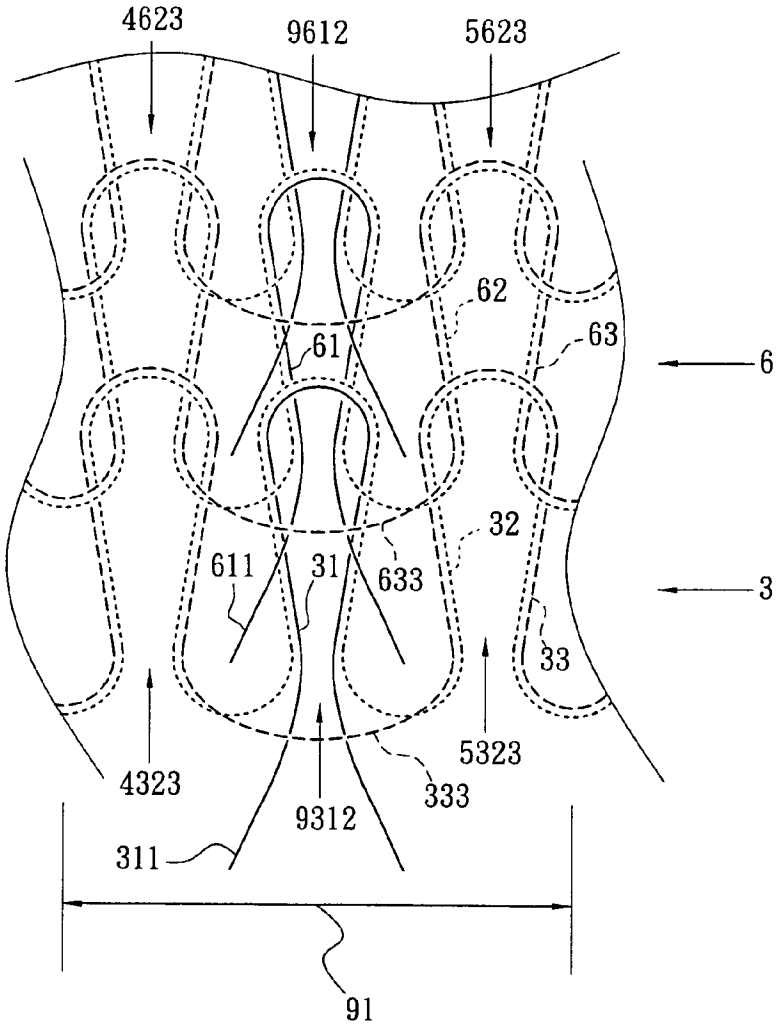
FIG. 5B is a fragmentary enlarged view according to FIG. 5A.

Refer to FIGS. 5A and 5B for a fragmentary schematic view of a second type structure of the corduroy fabric of the invention. It is substantially the same as the one shown in FIGS. 3A and 3B. The main difference is as follow:

In the drawings the fabric formed by two transverse weft yarn sets 3 and 6 also are marked for discussion. The transverse weft yarn set 3 includes three yarns 31, 32 and 33, and is crocheted separately by needles of a circular knitting machine to form a plurality of pile yarn warp loops 9312 and a plurality of binding yarn warp stitches 4323 and 5323. In one longitudinal warp loop pile zone 91, one pile yarn warp loop 9312 has two yarns 31 and 32 formed by two crochets of one needle. One yarn 31 has two pile ends 311. The bind yarn warp loops 4323 and 5323 also have two yarns 32 and 33 located respectively on the left and right sides of the pile yarn warp loop 9312. The two yarns 32 and 33 of the binding yarn warp loop 4323 are obtained by two crotches of one needle different from the one of the pile yarn warp loop 9312. The two yarns 32 and 33 of the binding yarn warp stitch 5323 are obtained by two crotches of one needle different the ones previously discussed. The binding yarn warp loops 4323 and 5323 have a common yarn 33, winding the pile yarn warp loop 9312 to form a binding yarn 333 cross with the two pile ends 311.

Another transverse weft yarn set 6 also includes three yarns 61, 62 and 63, and is crocheted separately by needles of the circular knitting machine to form a plurality of pile yarn warp loops 9612, and binding yarn warp loops 4623 and 5623. Like those previously discussed, in one longitudinal warp loop pile zone 91 one pile yarn warp loop 9612 has two yarns 61 and 62. The two yarns 61 and 62 of the pile yarn warp loop 9612 are obtained by two crochets feeding under the transverse weft yarn set 6 through the same needle which forms the pile yarn warp loop 9312 previously discussed. One yarn 61 has two pile ends 611. The binding yarn warp loops 4623 and 5623 also have two yarns 62 and 63 located respectively on the left and right sides of the pile yarn warp loop 9612. The two yarns 62 and 63 of the binding yarn warp stitch 4623 are obtained by two crochets feeding under the transverse weft yarn set 6 through the same needle of the binding yarn warp stitch 4323 previously discussed. The two yarns 62 and 63 of the binding yarn warp stitch 5623 are obtained by two crochets feeding under the transverse weft yarn set 6 through the same needle of the binding yarn warp loop 5323 previously discussed. The two binding yarn warp loops 4623 and 5623 have a common yarn 63, winding the pile yarn warp loop 9612 to form a binding yarn 633 cross with the two pile ends 611.

It is to be noted that the two yarns 61 and 62 of the pile yarn warp loop 9612 are obtained by the same needle forming the pile yarn warp loop 9312, that receives yarn feeding at a yarn outlet of the transverse weft yarn set 6 and crochets two times, then the needle releases the yarns 31 and 32 of the pile yarn warp stitch 9312 from a yarn release ring. Hence the yarns 61 and 62 of the pile yarn warp stitch 9612 pass through the yarns 31 and 32 of the pile yarn warp loop 9312 to form a consecutive cross weaving fashion. Thus, the needles are continuously moved to the next yarn outlet to feed the yarns and crochet the yarns. As a result, a consecutive cross weaving is proceeded to form a plurality of longitudinal warp pile zones 91 to become the corduroy fabric of the invention.

Figure 6:
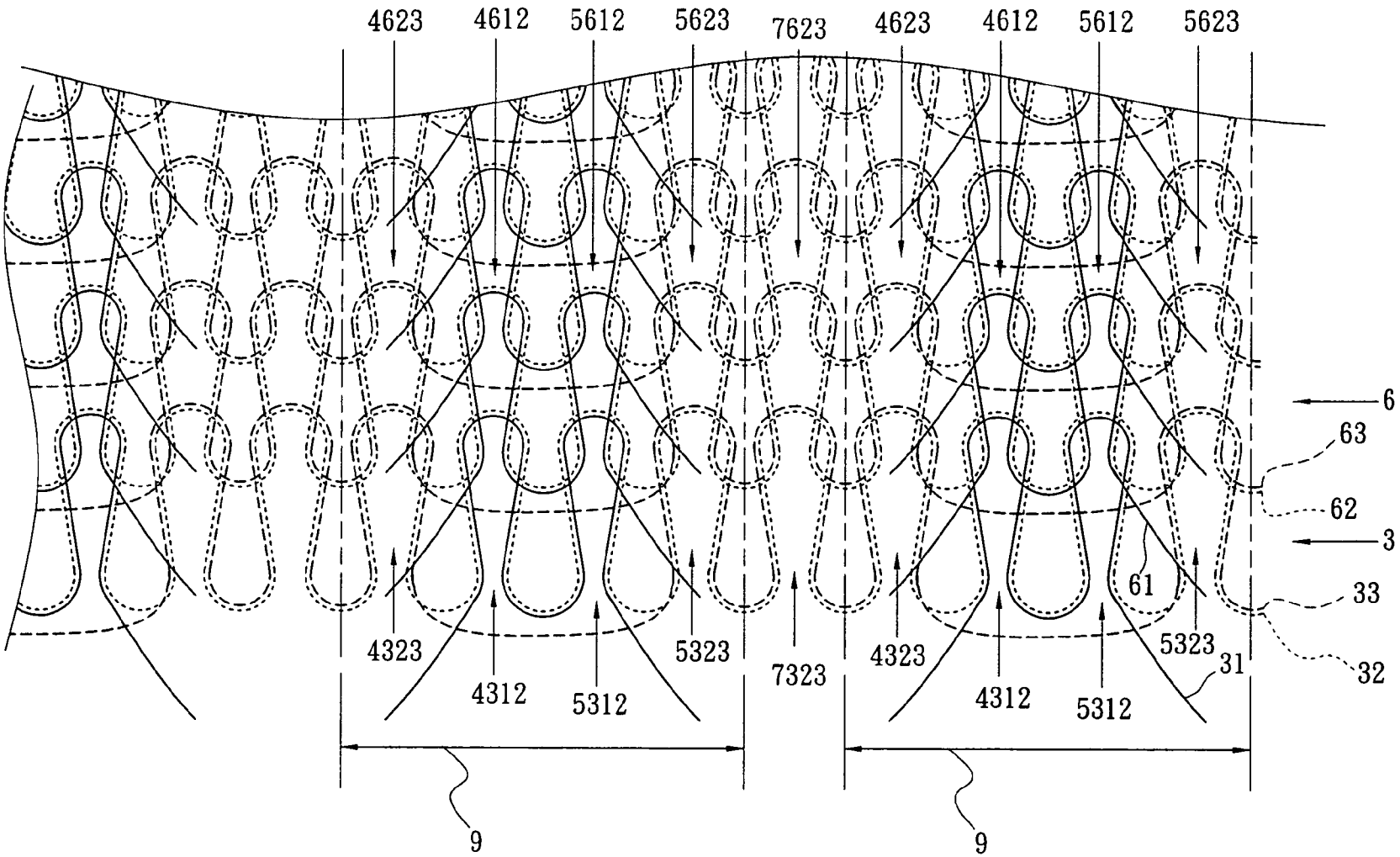
FIG. 6 is a fragmentary schematic view of a third type structure of the corduroy fabric of the invention

Refer to FIG. 6 for a fragmentary schematic view of a third type structure of the corduroy fabric of the invention. The longitudinal warp loop pile zone 9 is the same as the one shown in FIG. 3B. Alterations can be seen in FIG. 6. The transverse weft yarn set 3 has a spaced yarn warp loop 7323 consisting of two yarns 32 and 33. The spaced yarn warp loop 7323 is located between the binding yarn warp loops 5323 and 4323. The other transverse weft yarn set 6 also has a spaced yarn warp loop 7623 consisting of two yarns 62 and 63, and being located between the binding yarn warp loops 5623 and 4623. The yarns 62 and 63 of the spaced yarn warp loop 7623 pass through the yarns 32 and 33 of the other spaced yarn warp stitch 7323 to form a consecutive cross weaving fashion.

While the preferred embodiments of the invention have been set forth for the purpose of disclosure, modifications of the disclosed embodiments of the invention as well as other embodiments thereof may occur to those skilled in the art.

Accordingly, the appended claims are intended to cover all embodiments which do not depart from the spirit and scope of the invention.

What is claimed is:

1. A corduroy fabric fabricated through a circular knitting machine, comprising:

a plurality of transverse weft yarn sets each consisting of at least three yarns and including:

a plurality of pile yarn warp loops consisting of at least two yarns which have at least one yarn forming at least one pile end; and a plurality of binding yarn warp loops consisting of at least two yarns, each of the binding yarn warp loops being located respectively at two sides of a selected number of the pile yarn warp loops and having at least a common yarn winding the selected number of the pile yarn warp loops to form a binding yarn cross with the pile end;

wherein the pile yarn warp loops and the binding yarn warp loops of one transverse weft yarn set are crossly woven consecutively with longitudinal neighboring pile yarn warp loops and the binding yarn warp loops of a next transverse weft yarn set to form a plurality of longitudinal warp loop pile zones.

2. The corduroy fabric of claim 1, wherein the transverse weft yarn set has a plurality of spaced yarn warp loops consisting of at least two yarns, at least one of the spaced yarn warp loops being located in each neighboring longitudinal warp loop pile zone.

3. A corduroy fabric fabricated through a circular knitting machine, comprising:

a plurality of transverse weft yarn sets each consisting of at least three yarns and including:

a plurality of pile yarn warp loops consisting of at least two yarns which have at least one yarn forming at least one pile end; and a plurality of binding yarn warp loops consisting of at least two yarns, each of the binding yarn warp loops being located respectively at two sides of one of the pile yarn warp loops and having at least one common yarn winding the pile yarn warp loop to form a binding yarn cross with the pile end;

wherein the pile yarn warp stitches and the binding yarn warp loops of one transverse weft yarn set are crossly woven consecutively with longitudinal neighboring pile yarn warp loops and the binding yarn warp loops of a next transverse weft yarn set to form a plurality of longitudinal warp loop pile zones.

4. The corduroy fabric of claim 3, wherein the transverse weft yarn set has a plurality of spaced yarn warp loops consisting of at least two yarns, at least one of the spaced yarn warp stitches being located in each neighboring longitudinal warp stitch pile zone.

5. A corduroy fabric fabricated through a circular knitting machine, comprising:

a plurality of transverse weft yarn sets each consisting of at least three yarns and including:

a plurality of pile yarn warp loops consisting of at least two yarns which have at least one yarn forming at least one pile end; and a plurality of binding yarn warp loops consisting of at least two yarns, each of the binding yarn warp loops being located respectively at two sides of two neighboring pile yarn warp loops and having at least one common yarn winding the two neighboring pile yarn warp loops to form a binding yarn cross with the pile end;

wherein the pile yarn warp loops and the binding yarn warp loops of one transverse weft yarn set are crossly woven consecutively with longitudinal neighboring pile yarn warp loops and the binding yarn warp loops of a next transverse weft yarn set to form a plurality of longitudinal warp loop pile zones.

6. The corduroy fabric of claim 5, wherein the transverse weft yarn set has a plurality of spaced yarn warp loops consisting of at least two yarns, at least one of the spaced yarn warp loops being located in each neighboring longitudinal warp loop pile zone.

* * * * *